US009241602B2

(12) United States Patent
Lee et al.

(10) Patent No.: US 9,241,602 B2
(45) Date of Patent: Jan. 26, 2016

(54) DRIVING WHEEL ASSEMBLY AND ROBOT CLEANER HAVING THE SAME

(75) Inventors: Byoung In Lee, Suwon-si (KR); Hwi Chan Jang, Yongin-si (KR); Hyun Soo Jung, Seongnam-si (KR); Dong Won Kim, Hwaseong-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 593 days.

(21) Appl. No.: 13/590,274

(22) Filed: Aug. 21, 2012

(65) Prior Publication Data

US 2013/0056290 A1 Mar. 7, 2013

Related U.S. Application Data

(60) Provisional application No. 61/530,019, filed on Sep. 1, 2011.

(30) Foreign Application Priority Data

Oct. 5, 2011 (KR) ..... 10-2011-0101418

(51) Int. Cl.
*B60G 11/14* (2006.01)
*A47L 9/00* (2006.01)

(52) U.S. Cl.
CPC ..... *A47L 9/009* (2013.01); *A47L 2201/06* (2013.01)

(58) Field of Classification Search
CPC ..... B62K 5/007; B62K 7/0007; B62K 2007/0061; B60G 11/16; A47L 9/009; A47L 2201/04; B25J 5/007
See application file for complete search history.

(56) References Cited

U.S. PATENT DOCUMENTS 3,380,546 A * 4/1968 Rabjohn ..... B60L 11/1805 180/15
3,827,103 A * 8/1974 Nordeen ..... A47L 5/34 15/359
4,513,472 A 4/1985 Wells
(Continued)

FOREIGN PATENT DOCUMENTS

DE 10 2009 041 728 A1 6/2010
EP 1 806 084 A2 7/2007
(Continued)

OTHER PUBLICATIONS

European Search Report dated Jan. 16, 2015 issued in corresponding European Patent Application 14185173.3.
(Continued)

*Primary Examiner* — Brodie Follman
(74) *Attorney, Agent, or Firm* — Staas & Halsey LLP

(57) ABSTRACT

A driving wheel assembly and a robot cleaner having the same includes a main body and a driving wheel assembly including a driving wheel, a housing, a driving motor, a rotary member with rotation around a rotation shaft of the driving motor, where the rotary member includes a first unit and a second unit disposed at a position opposite to the driving wheel with respect to the rotation shaft of the driving motor, and a compression coil spring disposed between the housing and the second unit to apply pressure to the second unit, where a distance between a contact point where the compression coil spring and the second unit contact and the rotation shaft of the driving motor is shorter than a distance between a rotation shaft of the driving wheel and a rotation shaft of the driving motor.

9 Claims, 6 Drawing Sheets

(56) References Cited

U.S. PATENT DOCUMENTS

| | | | | |
|---|---|---|---|---|
| 4,700,427 | A * | 10/1987 | Knepper | A47L 11/4011 15/319 |
| 4,829,442 | A * | 5/1989 | Kadonoff | B25J 9/0003 180/169 |
| 4,938,309 | A | 7/1990 | Emdy | |
| 5,036,941 | A * | 8/1991 | Denzin | B60G 3/00 180/252 |
| 6,496,754 | B2 * | 12/2002 | Song | A47L 9/009 318/568.12 |
| 7,004,269 | B2 * | 2/2006 | Song | A47L 9/009 180/6.5 |
| 7,213,663 | B2 * | 5/2007 | Kim | A47L 9/009 189/251 |
| 7,296,643 | B2 * | 11/2007 | Philipson | B60K 7/0007 180/21 |
| 7,660,650 | B2 * | 2/2010 | Kawagoe | G05D 1/0219 180/167 |
| 7,721,829 | B2 * | 5/2010 | Lee | B62D 61/12 180/6.28 |
| 7,975,790 | B2 * | 7/2011 | Kim | B60G 3/01 180/65.51 |
| 8,092,272 | B2 * | 1/2012 | Yang | A63H 11/10 446/460 |
| 8,186,469 | B2 * | 5/2012 | Yim | B25J 5/007 180/218 |
| 8,774,970 | B2 * | 7/2014 | Knopow | A47L 5/28 15/319 |
| 8,950,038 | B2 * | 2/2015 | Won | A47L 5/30 15/319 |
| 2002/0104300 | A1 * | 8/2002 | Hunt | A01D 34/008 56/10.6 |
| 2003/0204923 | A1 | 11/2003 | Nakamura | |
| 2004/0262060 | A1 * | 12/2004 | Kim | A47L 9/009 180/65.51 |
| 2005/0027396 | A1 * | 2/2005 | Yang | B60G 17/0157 700/245 |
| 2005/0150519 | A1 | 7/2005 | Keppler et al. | |
| 2010/0125968 | A1 | 5/2010 | Ho | |
| 2010/0170057 | A1 * | 7/2010 | Lee | A47L 5/22 15/319 |
| 2012/0181099 | A1 * | 7/2012 | Moon | A47L 9/009 180/65.51 |
| 2013/0056290 | A1 * | 3/2013 | Lee | A47L 9/009 180/65.6 |
| 2014/0145495 | A1 * | 5/2014 | Shin | B25J 5/007 301/6.5 |
| 2014/0152075 | A1 * | 6/2014 | Kanatani | B60K 7/0007 301/6.5 |

FOREIGN PATENT DOCUMENTS

| | | | |
|---|---|---|---|
| EP | 1 806 086 | A2 | 7/2007 |
| EP | 2 036 755 | A2 | 3/2009 |
| EP | 2 443 978 | A2 | 4/2012 |
| FR | 2 856 622 | A1 | 12/2004 |
| JP | 2009-82289 | | 4/2009 |
| KR | 10-2004-0096253 | | 11/2004 |
| KR | 2007-0070658 | A | 7/2007 |
| KR | 10-2010-0136882 | | 12/2010 |
| WO | 2007/137234 | A2 | 11/2007 |

OTHER PUBLICATIONS

European Search Report dated Feb. 14, 2013 in corresponding European Patent Application 12180883.6.

European Search Report dated Feb. 22, 2013 in corresponding European Patent Application 12180884.4.

U.S. Restriction Requirement mailed Jul. 14, 2015 in related U.S. Appl. No. 13/599,376.

European Search Report dated Nov. 22, 2012 issued in corresponding European Patent Application 12181180.6.

U.S. Election Requirement mailed Oct. 2, 2015 in related U.S. Appl. No. 13/590,618.

* cited by examiner

DRIVING WHEEL ASSEMBLY AND ROBOT CLEANER HAVING THE SAME

CROSS-REFERENCE TO RELATED APPLICATIONS

This application claims the priority benefit of U.S. Patent Ser. No. 61/530,019, filed on Sep. 1, 2011 in the USPTO, and Korean Patent Application No. 10-2011-0101418, filed on Oct. 5, 2011 in the Korean Intellectual Property Office, the disclosure of which is incorporated herein by reference.

BACKGROUND

1. Field

The following description relates to a driving wheel assembly which drives a robot cleaner, and a robot cleaner having the same.

2. Description of the Related Art

In general, a robot cleaner is an apparatus which intakes foreign substances, such as dust, from a floor surface to clean a region to be cleaned while autonomously travelling about the region to be cleaned without manipulation by a user.

Such a robot cleaner includes driving wheels to drive a robot cleaner main body, and the driving wheels drive the robot cleaner main body using frictional force generated between the driving wheels and the floor surface contacting the driving wheels.

In order for the robot cleaner to have consistent traveling performance in various floor conditions, such as a hard floor, or a carpet, for example, frictional force generated between the driving wheels and the floor surface contacting the driving wheels needs to be consistently maintained regardless of the state or condition of the floor surface. For this purpose, applying pressure to the driving wheels in a direction towards the floor surface is required.

Conventionally, a tension coil spring is used to apply pressure to the driving wheel in the direction towards the floor surface. However, the tension coil spring may cause a wide range of applied pressure to the driving wheel according to a displacement of the driving wheel. Furthermore, in order to reduce such range of applied pressure, the length of the tension coil spring is increased. Consequently, an installation space for installing the tension coil spring is increased.

SUMMARY

Therefore, the following description relates to a driving wheel assembly having an improved structure which stably travels regardless of the state and condition of a floor surface, and a robot cleaner having the same. The driving wheel assembly includes a structure where a change in length of a compression coil spring is smaller than a corresponding displacement of a driving wheel. Therefore, a compact-sized robot cleaner with improved mobility on various types of floor surfaces may be designed.

Additional aspects of the invention will be set forth in part in the description which follows and, in part, will be obvious from the description, or may be learned by practice of the invention.

In accordance with one aspect, a robot cleaner includes a main body and a driving wheel assembly, including a driving wheel to drive the main body, a housing, a driving motor connected to one side of the housing to generate rotary force to rotate the driving wheel, a rotary member with rotation around a rotation shaft of the driving motor, where the rotary member includes a first unit to which the driving wheel is connected and a second unit disposed at a position opposite to the driving wheel with respect to the rotation shaft of the driving motor, and a compression coil spring disposed between the housing and the second unit to apply pressure to the second unit, where a distance between a contact point where the compression coil spring and the second unit contact and the rotation shaft of the driving motor is shorter than a distance between a rotation shaft of the driving wheel and the rotation shaft of the driving motor.

The compression coil spring may apply pressure to the second unit in the tangential direction of a trajectory formed by the rotation shaft of the driving motor and the second unit during a process of rotating the rotary member.

The compression coil spring and driving wheel may be disposed at positions on opposite sides of the rotation shaft of the driving motor.

The compression coil spring may be disposed at a position opposite to the driving wheel with respect to a first straight line passing through a first rotation point around which the first unit is rotated and perpendicular to a second straight line connecting the first rotation point around which the first unit is rotated and a second rotation point around which the driving wheel rotatably connected to the first unit is rotated.

A pressing point may be formed at a position where the compression coil spring and the second unit to which the compression coil spring applies pressure contact, and the second unit may protrude from one side of the first unit where a third straight line connecting a first rotation point around which the first unit is rotated and the pressing point and the first unit meet, in the radial direction of a trajectory formed during a process of rotating the pressing point.

A distance between the pressing point and the first rotation point may be shorter than a distance between the first rotation point and a second point around which the driving wheel rotatably connected to the first unit is rotated.

The driving wheel assembly may further include a support rib protruding from one side of the housing adjacent to the rotation shaft of the driving motor to the inside of the housing and supporting one end of the compression coil spring.

The first unit, the second unit, and the support rib may form an accommodation part accommodating the compression coil spring.

The first unit may include power transmission gears transmitting rotary force of the driving motor to the driving wheel.

In accordance with another aspect, a robot cleaner includes a main body and a driving wheel assembly to drive the main body, wherein the driving wheel assembly includes a housing, a driving motor connected to one side of the housing, a rotary member including a first unit connected to the housing to be rotated around a rotation shaft of the driving motor, and a second unit protruding from one side of the first unit, a driving wheel rotatably connected to the first unit, and a compression coil spring disposed between a support rib protruding from one side of the housing adjacent to the rotation shaft of the driving motor to the inside of the housing and the second unit, and applying pressure to the second unit in the tangential direction of a trajectory formed by the rotation shaft of the driving motor and the second unit during a process of rotating the rotary member.

The compression coil spring may be disposed closer to the rotation shaft of the driving motor than the driving wheel.

The compression coil spring may include a fixed terminal contacting the support rib and a pressing terminal contacting the second unit and applying pressure to the second unit.

The support rib may include a first support surface supporting the fixed terminal, and the second unit may include a second support surface supporting the pressing terminal.

The compression coil spring may be disposed at a position opposite to the driving wheel with respect to a first straight line passing through a first rotation point around which the first unit is rotated and perpendicular to a second straight line connecting the first rotation point around which the first unit is rotated and a second rotation point around which the driving wheel is rotated.

A pressing point may be formed at a position where the pressing terminal and the second unit contact, and the second unit may protrude from one side of the first unit where a third straight line connecting a first rotation point around which the first unit is rotated and the pressing point and the first unit meet, in the radial direction of a trajectory formed during a process of rotating the pressing point.

The first unit may include power transmission gears transmitting rotary force of the driving motor to the driving wheel.

In accordance with a further aspect, a driving wheel assembly mounted on a main body of a robot cleaner to drive the robot cleaner includes a housing, a driving motor connected to one side of the housing, a first unit connected to the housing to be rotated around a rotation shaft of the driving motor, and a second unit protruding from one side of the first unit, a driving wheel rotatably connected to the first unit, and at least one compression coil spring disposed at a position opposite to the driving wheel with respect to a straight line passing through the rotation shaft of the driving motor and applying pressure to the second unit in the tangential direction of a trajectory formed by the rotation shaft of the driving motor and the second unit during a process of rotating the first unit.

In accordance with another aspect, a driving wheel assembly includes a driving motor including a motor rotation shaft; a connecting assembly connected to and rotating around the motor rotation shaft; a driving wheel comprising a wheel rotation shaft, and disposed at a first end of the connecting assembly; and a coil spring disposed at a position to apply tangential pressure to a second end of the connecting assembly along a direction of rotation, where the first end and the second end of the connecting assembly are disposed on opposite sides of the motor rotation shaft, and a rotation of the connecting assembly results in a greater displacement of the driving wheel rotation shaft than a corresponding change in length of the coil spring.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
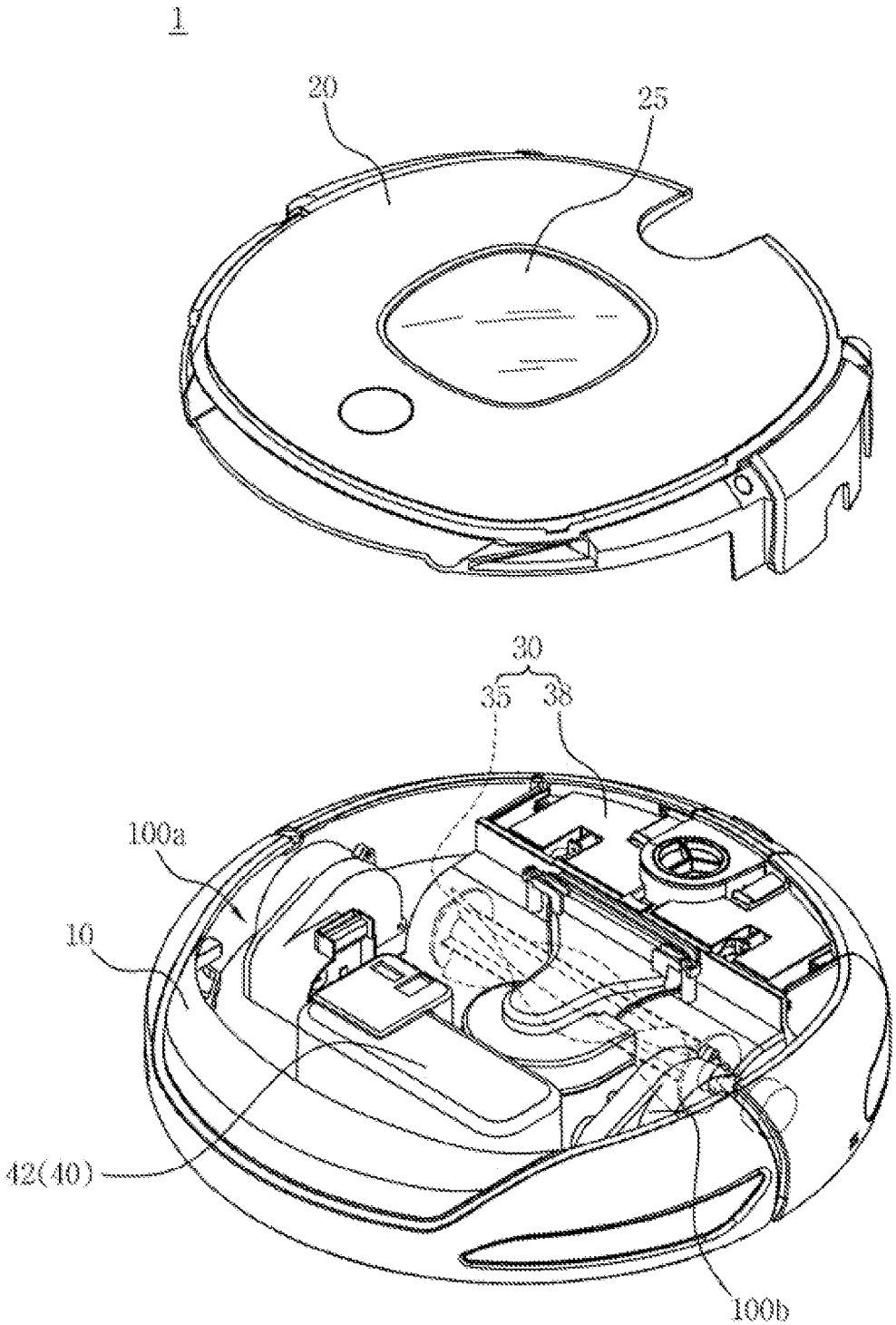
FIG. 1 is a perspective view illustrating the configuration of a robot cleaner in accordance with one embodiment.

Reference will now be made in detail to the embodiments of the present invention, examples of which are illustrated in the accompanying drawings, wherein like reference numerals refer to like elements throughout.

FIG. 1 is a perspective view illustrating the configuration of a robot cleaner in accordance with one embodiment.

As shown in FIG. 1, the robot cleaner 1 includes a main body 10 forming the external appearance of the robot cleaner 1, a cover 20 covering the upper portion of the main body 10, a brush unit 30 sweeping or scattering dust off a space to be cleaned, a power unit 40 supplying driving power to drive the main body 10, and driving wheel assemblies 100*a* and 100*b* driving the main body 10.

The main body 10 forms the external appearance of the robot cleaner 1 and supports various parts installed within the main body 10.

The cover 20 includes a transmitting window 25 transmitting light generated from an upper camera unit (not shown) to photograph an upper image perpendicular to the traveling direction of the main body 10.

The brush unit 30 includes a main brush 35 mounted at an inlet (not shown) formed at the lower portion of the main body 10, a main brush motor (not shown) rotating the main brush 35, and a dust case 38 collecting foreign substances, such as dust gathered by the main brush 35.

The main brush 35 sweeps or scatters dust off a floor surface under the main body 10, thereby improving dust suction efficiency. Such a main brush 35 has a drum shape, and includes a roller and brush. The brush unit 30 may further include side brushes (not shown) disposed at both sides of the main brush 35 to sweep dust off a region which the main brush 35 may not approach to improve cleaning efficiency.

The power unit 40 includes driving motors 130 rotating driving wheels 120, and a battery 42 electrically connected to the main brush motor (not shown) rotating the main brush 35 and respective driving units driving the main body 10 and supplying driving power.

The battery 42 is a second battery which may be rechargeable, and may be charged with power supplied from a docking station (not shown) if the main body 10 completes a cleaning process and is then connected to the docking station (not shown).

The driving wheel assemblies 100*a* and 100*b* are respectively provided at both sides of the center of the main body 10, and allow the main body 10 to execute moving operations, such as forward movement, backward movement, or rotation, for example, during the cleaning process of the main body. Hereinafter, the driving wheel assembly 100*a* located at the right side in the forward movement direction of the main body 10 will be exemplarily described, and the following description may be applied to the driving wheel assembly 100*b* located at the left side in the forward movement direction of the main body 10 unless mentioned otherwise.

Figure 2:
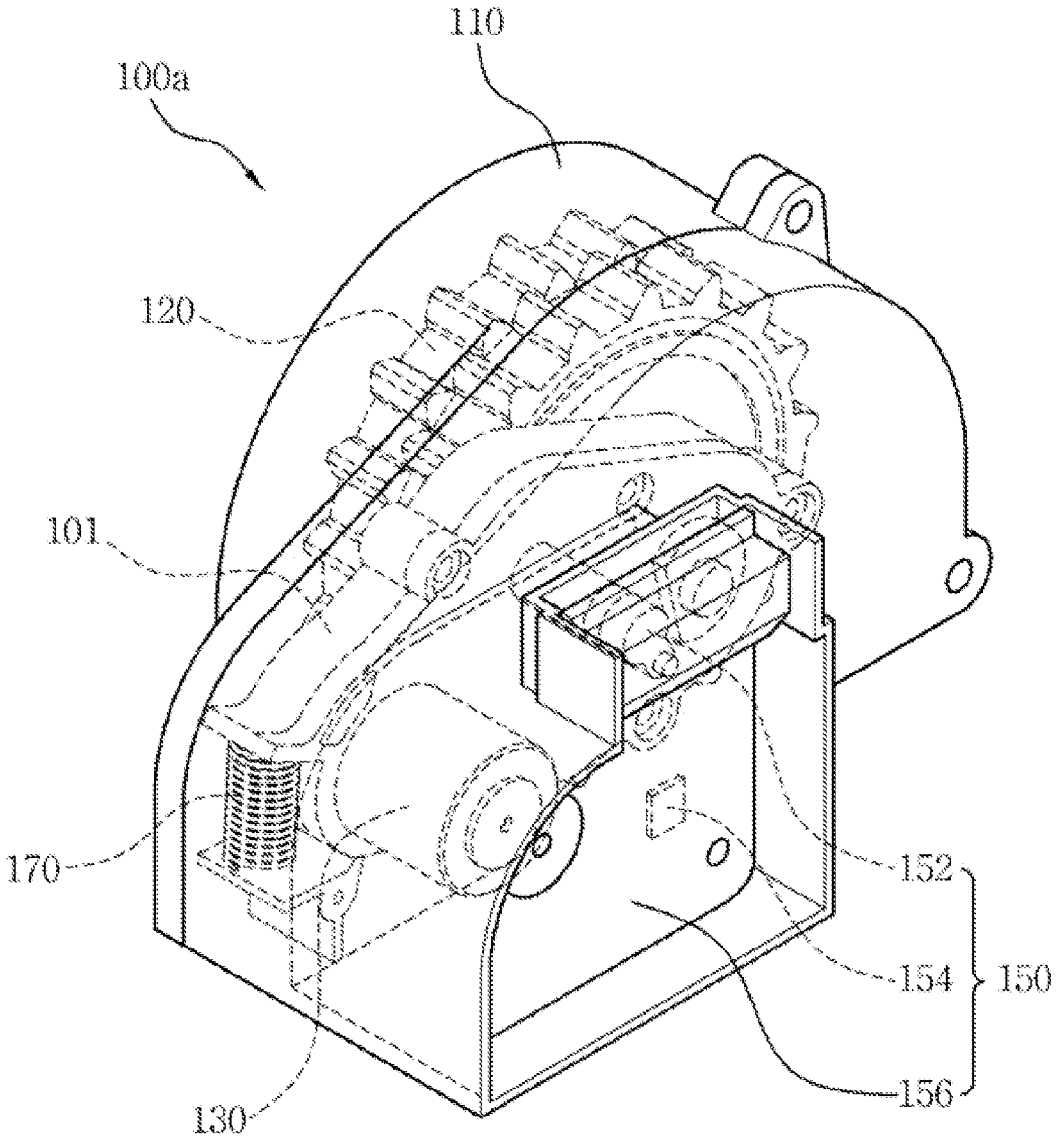
FIG. 2 is a perspective view illustrating a driving wheel assembly in accordance with the embodiment, extracted from FIG. 1.
Figure 3:
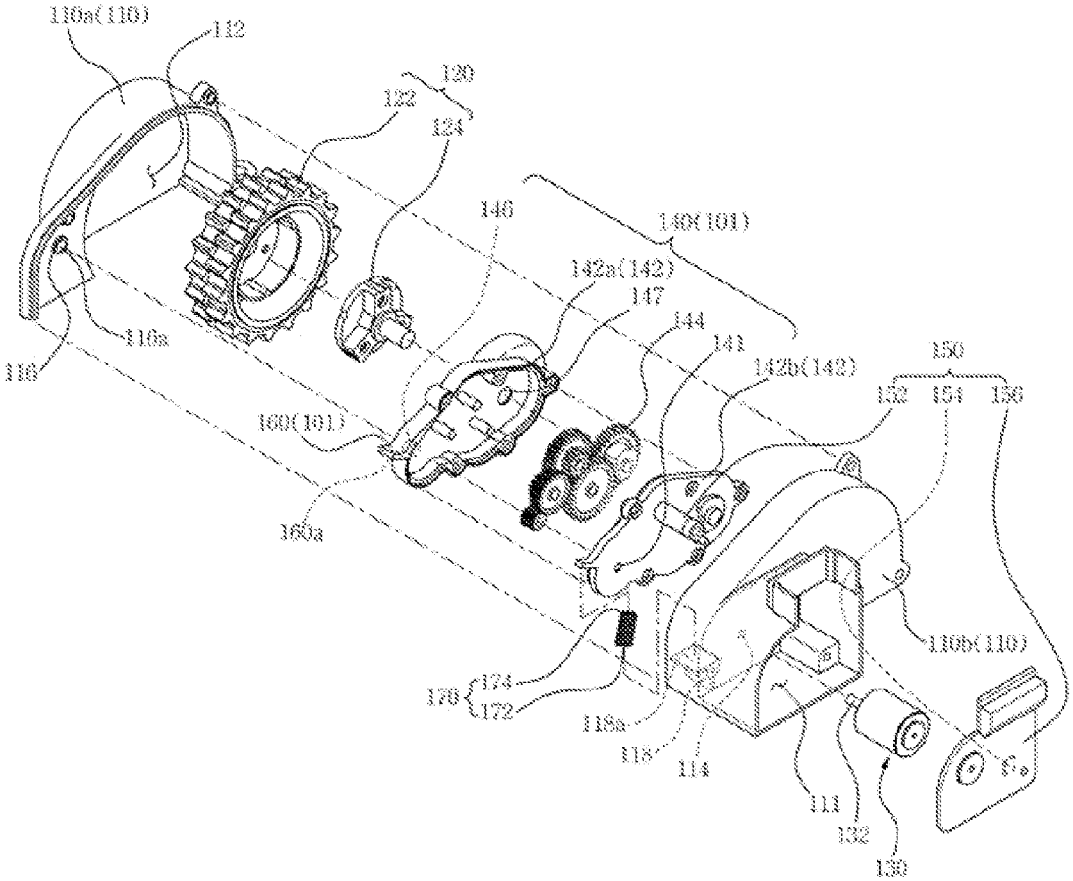
FIG. 3 is an exploded perspective view of the driving wheel assembly shown in FIG. 2.
Figure 4:
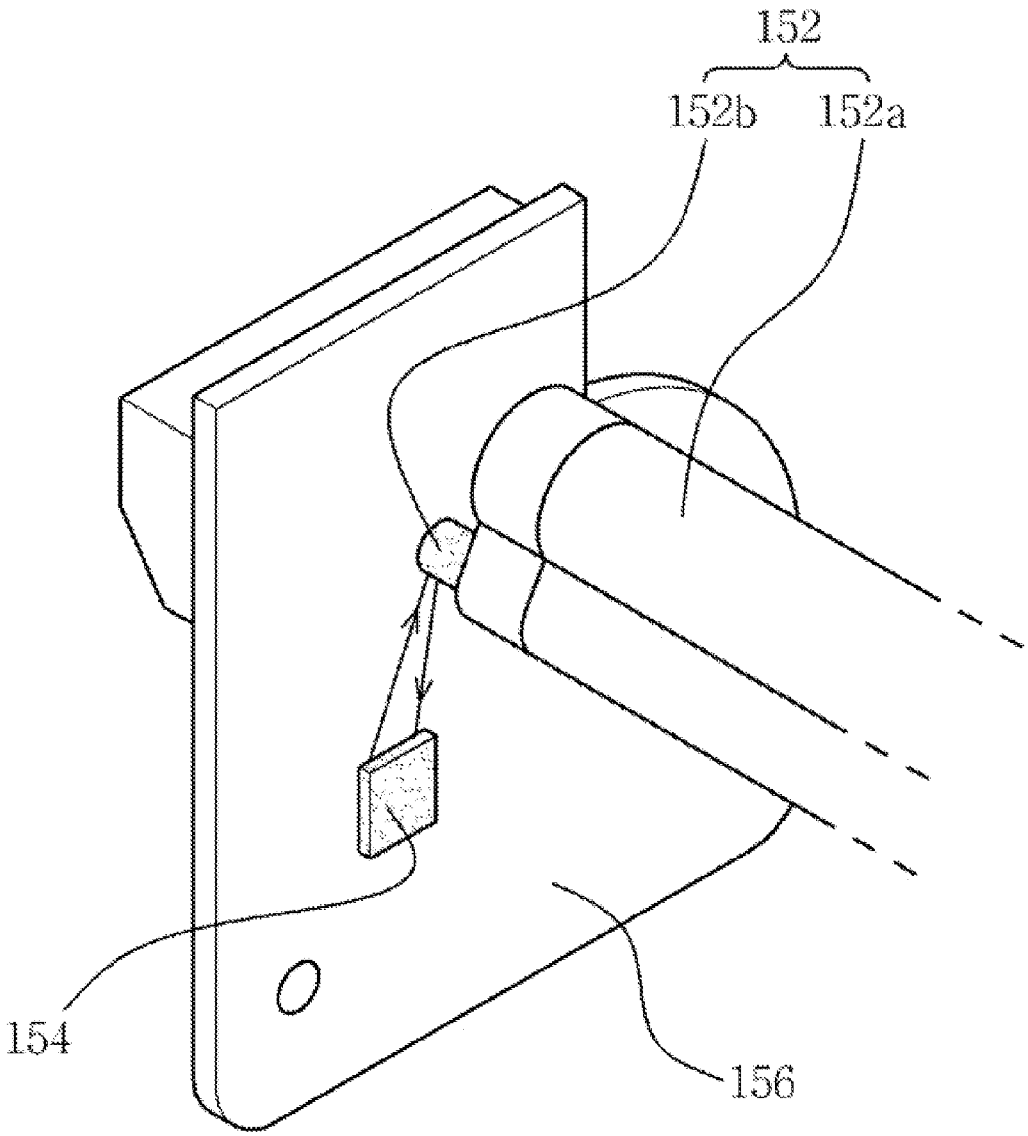
FIG. 4 is a perspective view illustrating a sensing body and a sensed body extracted from the driving wheel assembly shown in FIG. 2.

FIG. 2 is a perspective view illustrating a driving wheel assembly in accordance with the embodiment extracted from FIG. 1, FIG. 3 is an exploded perspective view of the driving wheel assembly shown in FIG. 2, and FIG. 4 is a perspective view illustrating a sensing body and a sensed body extracted from the driving wheel assembly shown in FIG. 2.

As shown in FIGS. 2 to 4, the driving wheel assembly 100*a* includes a housing 110, the driving wheel 120 driving the main body 10, a driving motor 130 connected to one side of the housing 110 and rotating the driving wheel 120, a rotary member 101 connected to the housing 110 to be rotatable around a rotation shaft 132 of the driving motor 130, and a sensing unit 150 detecting displacement of the driving wheel 120.

The housing 110 includes an accommodation part 112 accommodating the driving wheel 120 and the rotary member 101, a first connection hole 114 to which the driving motor 130 is connected, a first connection protrusion 116 connected to the rotary member 101, and a support rib 118 supporting one end of a compression coil spring 170.

The lower portion of the accommodation part 112 is opened such that the rotary member 101 connected to the housing 110 and the driving wheel 120 connected to the rotary member 101 may move upwards and downwards according to the kind and state of a floor surface of the space to be cleaned.

The first connection hole 114 is formed on one side surface 110*b* of the housing 110, and allows the rotation shaft 132 of the driving motor 130 to be connected to the rotary member 101 within the housing 110.

The first connection protrusion 116 protrudes from the inner plane of the other side surface 110*a* opposite the side surface 110*b* of the housing 110, to which the driving motor 130 is connected, to the inside of the housing 110 by a designated length. An accommodation hole 116*a* rotatably accommodating a second connection protrusion 146 of the rotary member 101 to allow the rotary member 101 to be rotated around the first connection protrusion 116 is provided at the center of the first connection protrusion 116. Further, the first connection protrusion 116 may be disposed coaxially with the first connection hole 114 and the rotation shaft 132 of the driving motor 130 passing through the first connection hole 114.

The support rib 118 protrudes from the inner plane of the side surface 110*b* of the housing 110, to which the driving motor 130 is connected, to the inside of the housing 110 by a designated length, and supports one end of the compression coil spring 170 applying pressure to a first unit 140 of the rotary member 101.

The driving wheel 120 includes a wheel part 122 directly contacting the floor surface of the space to be cleaned to execute traveling of the main body 10, and a driving shaft 124 connected to the first unit 140 of the rotary member 101 under the condition that the driving shaft 124 is fixed to the wheel part 122 to rotate the wheel part 122.

The driving motor 130 is connected to the outer plane of the side surface 110*b* of the housing 110 provided with the first connection hole 114, and the rotation shaft 132 of the driving motor 130 passes through the first connection hole 114 and is connected to the first unit 140 within the housing 110. Driving force of the driving motor 130 is transmitted to the driving shaft 124 through the rotation shaft 132 and power transmission gears 144 connected to the rotation shaft 132, thus rotating the driving wheel 120.

The first unit 140 includes a female case 142, the power transmission gears 144 engaged with each other and rotatably disposed within the female case 142, and the second connection protrusion 146 connecting the first unit 140 to the housing 110.

The female case 142 rotatably supports the power transmission gears 144 disposed therein.

The power transmission gears 144 are rotatably supported by the female case 142 under the condition that they are engaged with each other, and connect the rotation shaft 132 of the driving motor 130 and the driving shaft 124 of the driving wheel 120 to transmit driving force of the driving motor 130 to the driving shaft 124. The rotation shaft 132 may pass through a second connection hole 141 formed on one side surface 142*b* of the female case 142 and be connected to one of the power transmission gears 144, and the driving shaft 124 may pass through a third connection hole 147 formed on the other side surface 142*a* of the female case 142 and be connected to one of the remaining power transmission gears 44 which are not connected to the rotation shaft 132.

The second connection protrusion 146 protrudes from the side surface 142*a* of the female case 142 in a direction towards the first connection protrusion 116 by a designated length, and is rotatably connected to the accommodation hole 116*a* formed on the first connection protrusion 116.

A second unit 160 rotated around the rotation shaft 132 of the driving motor 130 together with the first unit 140 is provided at one side of the female case 142. The second unit 160 may be formed integrally with the first unit 140.

The first unit 140 is rotatably connected to the housing 110 through the second connection protrusion 146, and is elastically supported by the housing 110 by the second unit 160 and the compression coil spring 170.

The sensing unit 150 detecting displacement of the driving wheel 120 includes a sensed body 152 provided on the first unit 140, a sensing body 154 sensing the sensed body 152, and a bracket 156 fixing the sensing body 154 to the housing 110.

The sensed body 152 includes a protruding rib 152*a* protruding from the side surface 142*b* of the female case 142 in a direction towards the side surface 110*b* of the housing 110, and a magnet 152*b* connected to one end of the protruding rib 152*a*.

A driving motor accommodation part 111 accommodating the driving motor 130 is provided at one side of the housing 110, and the bracket 156 supporting and fixing the sensing body 156 is connected to the driving motor accommodation part 111.

The sensing body 154 is fixed to one side of the bracket 156, senses a separation distance with the sensed body 152 through magnetic interaction with the magnet 152*b* moving together with the first unit 140 within the driving motor accommodation part 111, and converts the sensed separation distance with the sensed body 152 into a standardized parameter, such as voltage, to detect displacement of the driving wheel 120.

Hereinafter, the structure and principle of applying pressure to the driving wheel 120 driving the robot cleaner 1 will be described in detail.

Figure 5A:
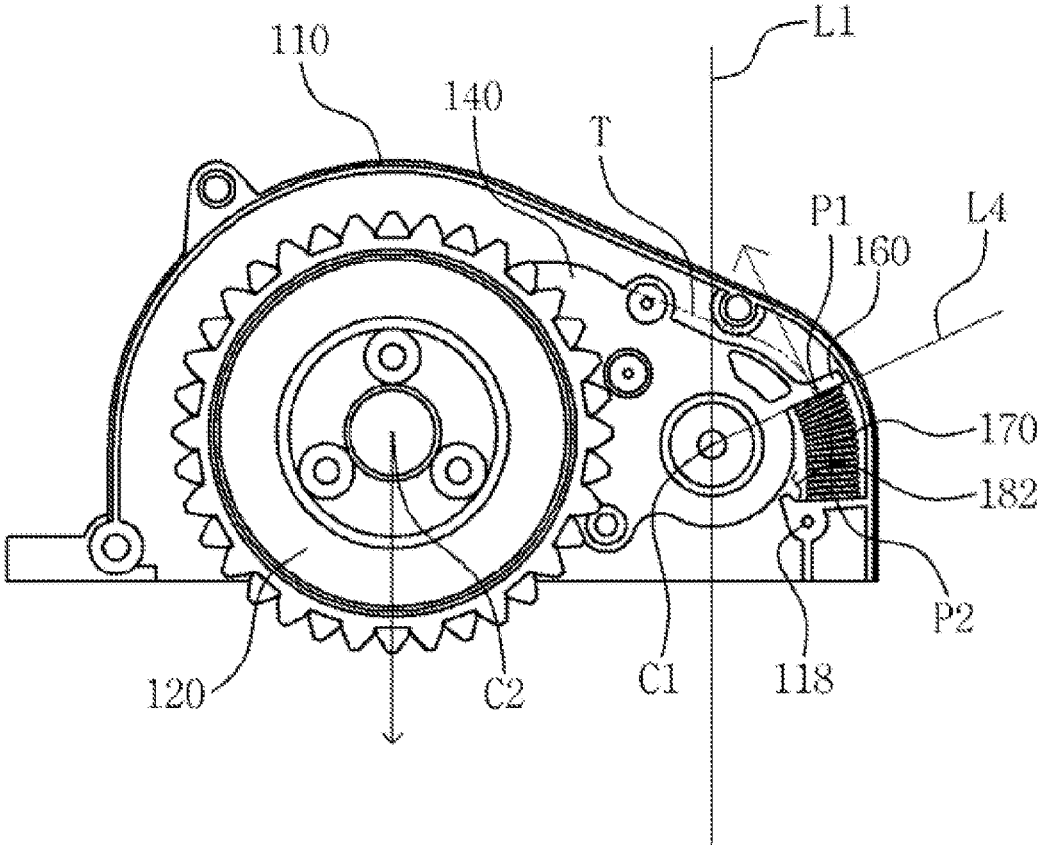
FIGS. 5A and 5B are views illustrating operating states of a driving wheel according to change of a floor surface.
Figure 5B:
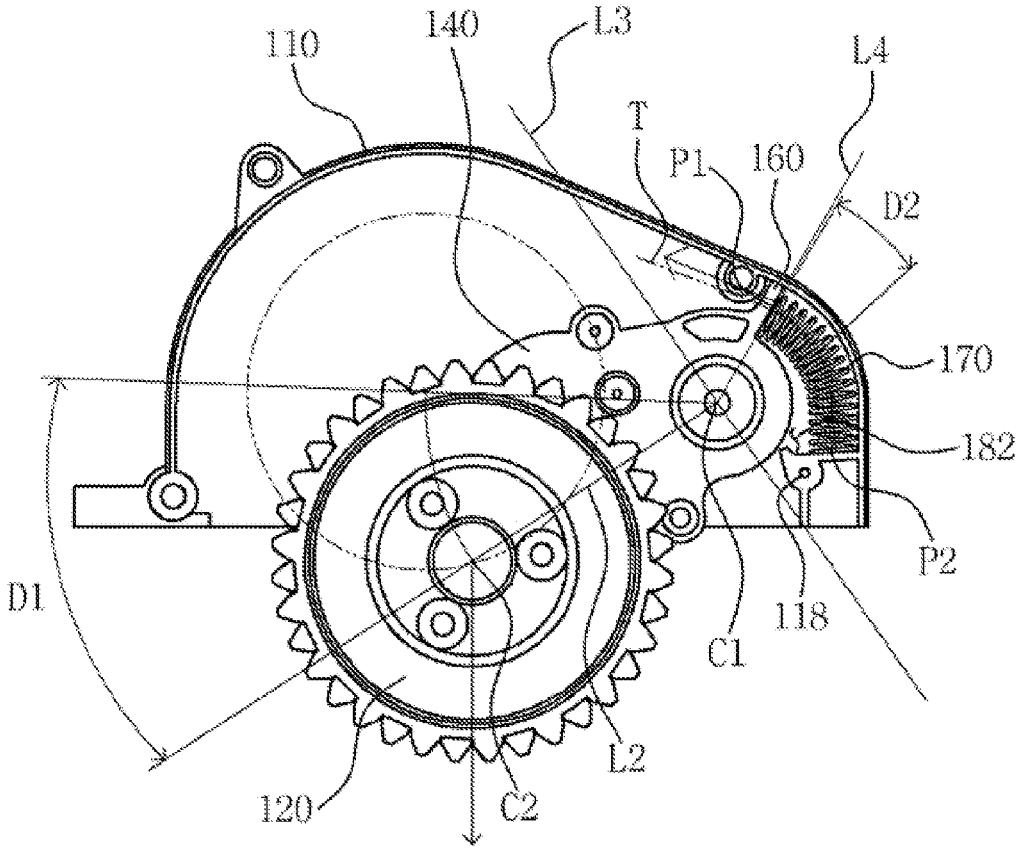

FIGS. 5A and 5B are views illustrating operating states of the driving wheel according to a change of a floor surface. FIG. 5A illustrates the operating state of the driving wheel when the robot cleaner main body travels about a hard floor surface, and FIG. 5B illustrates the operating state of the driving wheel when the robot cleaner main body travels about a soft floor surface, such as a carpet, for example.

As shown in FIGS. 2 to 5B, the compression coil spring 170 is accommodated in an accommodation part 182 formed by the first unit 140, the second unit 160 and the support rib 118, and applies pressure to the second unit 160.

The compression coil spring 170 includes a fixed terminal 172 which is fixed by contact with a first support surface 118*a* provided on the support rib 118, and a pressing terminal 174 which presses the second unit 160 by contact with a second support surface 160*a* of the second unit 160. A fixed point P2 is formed on the first support surface 118*a* contacting the fixed terminal 172, and a pressing point P1 is formed on the second support surface 160*a* contacting the pressing terminal 174.

The compression coil spring 170 in a compressed state is accommodated in the accommodation part 182 and applies pressure to the second unit 160 in the tangential direction of a trajectory T formed by the rotation shaft 132 of the driving motor 130 and the pressing point P1 during the rotating process of the second unit 160, and pressure applied to the second unit 160 by the compression coil spring 170 is transmitted to the driving wheel 120 contacting the floor surface through the first unit 140.

The compression coil spring 170 is disposed at a position opposite to the driving wheel 120 with respect to a first straight line L1 extending from the floor surface which the driving wheel 120 contacts in the vertical direction and passing through the rotation shaft 132 of the driving motor 130. Further, the compression coil spring 170 is disposed at a position opposite to the driving wheel 120 with respect to a third straight line L3 perpendicular to a second straight line L2 connecting a first rotation point C1 around which the first unit 140 is rotated and a second rotation point C2 around which the driving wheel 120 rotatably connected to the first unit 140 is rotated, and is disposed at a position closer to the rotation shaft 132 of the driving motor 130 than the driving wheel 120.

The second unit 160 protrudes from one side of the first unit 140 where a fourth straight line L4 connecting the first rotation point C1 and the pressing point P1 and the first unit 140 meet, in the radial direction of the trajectory T formed during the rotating process of the pressing point P1, and includes the second support surface 160*a* contacting the pressing terminal 174 of the compression coil spring 170.

The pressing point P1 is formed on the second support surface 160*a* contacting the pressing terminal 174, as described above, and the distance between the pressing point P1 and the first rotation point C1 is shorter than the distance between the first rotation point C1 and the second rotation point C2.

The support rib 118 protruding from the inner plane of the side surface 110*b* of the housing 110 adjacent to the first rotation point C1 to the inside of the housing 110, and includes the first support surface 118*a* contacting the fixed terminal 172 of the compression coil spring 170. The fixed point P2 is formed on the first support surface 118*a* contacting the fixed terminal 172.

The second unit 160 and the support rib 118 are disposed in a direction opposite to the driving wheel 120 and the second rotation point C2 with respect to the first straight line L1 and the third straight line L3.

Due to such a structure, as shown in FIGS. 5A and 5B, a length change D2 of the compression coil spring 170 is smaller than a displacement D1 of the driving wheel 120 according to the material or state of the floor surface. Because a change of pressure applied to the driving wheel 120 according to the displacement of the driving wheel 120 is as small as the length change of the compression coil spring 170, the main body 10 of the robot cleaner 1 may stably travel. Further, because a space in the accommodation part 112 in the housing 110, occupied by a structure applying pressure to the driving wheel 120, i.e., the first unit 140, the second unit 160, and the support rib 118, is small and the length of the compression coil spring 170 is minimized, a robot cleaner 1 having a compact size may be designed.

As is apparent from the above description, a driving wheel assembly and a robot cleaner having the same stably apply pressure to a driving wheel regardless of displacement of the driving wheel generated according to various states and conditions of floor surfaces, and thus traveling performance of the robot cleaner may be improved.

Further, a space within a robot cleaner main body occupied by a structure to apply pressure to the driving wheel is reduced, and thus the robot cleaner having a compact size may be designed.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A robot cleaner comprising:

a main body; and a driving wheel assembly, comprising:

a driving wheel to drive the main body;

a housing;

a driving motor connected to one side of the housing to generate rotary force to rotate the driving wheel;

a rotary member with rotation around a rotation shaft of the driving motor, wherein the rotary member comprises a first unit to which the driving wheel is connected and a second unit disposed at a position opposite to the driving wheel with respect to the rotation shaft of the driving motor; and a compression coil spring disposed between the housing and the second unit to apply pressure to the second unit, wherein a distance between a contact point where the compression coil spring and the second unit contact and the rotation shaft of the driving motor is shorter than a distance between a rotation shaft of the driving wheel and the rotation shaft of the driving motor.

2. The robot cleaner according to claim 1, wherein the compression coil spring applies pressure to the second unit in the tangential direction of a trajectory formed by the rotation shaft of the driving motor and the second unit during a process of rotating the rotary member.

3. The robot cleaner according to claim 2, wherein the compression coil spring and driving wheel are disposed at positions on opposite sides of the rotation shaft of the driving motor.

4. The robot cleaner according to claim 1, wherein the compression coil spring is disposed at a position opposite to the driving wheel with respect to a first straight line passing through a first rotation point around which the first unit is rotated and perpendicular to a second straight line connecting the first rotation point around which the first unit is rotated and a second rotation point around which the driving wheel rotatably connected to the first unit is rotated.

5. The robot cleaner according to claim 1, wherein:

a pressing point is formed at a position where the compression coil spring and the second unit to which the compression coil spring applies pressures contact; and the second unit protrudes from one side of the first unit where a third straight line connecting a first rotation point around which the first unit is rotated and the pressing point and the first unit meet, in the radial direction of a trajectory formed during a process of rotating the pressing point.

6. The robot cleaner according to claim 5, wherein a distance between the pressing point and the first rotation point is shorter than a distance between the first rotation point and a second point around which the driving wheel rotatably connected to the first unit is rotated.

7. The robot cleaner according to claim 1, wherein the driving wheel assembly further comprises a support rib protruding from one side of the housing adjacent to the rotation shaft of the driving motor to the inside of the housing and supporting one end of the compression coil spring.

8. The robot cleaner according to claim 7, wherein the first unit, the second unit, and the support rib form an accommodation part accommodating the compression coil spring.

9. The robot cleaner according to claim 1, wherein the first unit comprises power transmission gears transmitting rotary force of the driving motor to the driving wheel.

* * * * *